United States Patent [19]

Pirklbauer et al.

[11] Patent Number: 4,699,361

[45] Date of Patent: Oct. 13, 1987

[54] SHAFT FURNACE ARRANGEMENT FOR THE DIRECT REDUCTION OF IRON ORES

[75] Inventors: Wilfried Pirklbauer, Neuhofen; Klaus Wieser, Linz, both of Austria

[73] Assignee: Voest-Alpine Aktiengesellschaft, Austria

[21] Appl. No.: 760,942

[22] Filed: Jul. 31, 1985

[30] Foreign Application Priority Data

Aug. 17, 1984 [AT] Austria ..... 2643/84

[51] Int. Cl.[4] ..... F27B 1/16

[52] U.S. Cl. ..... 266/189; 75/34

[58] Field of Search ..... 266/189, 218, 270; 75/34

[56] References Cited

U.S. PATENT DOCUMENTS

| | | | |
|---|---|---|---|
| 1,003,628 | 9/1911 | Mathesius | 266/186 |
| 3,450,396 | 6/1969 | Pantke et al. | 266/186 |
| 4,032,123 | 6/1977 | Cruse, Jr. et al. | 266/186 |
| 4,256,290 | 3/1981 | Coccia | 266/195 |

FOREIGN PATENT DOCUMENTS

| | | |
|---|---|---|
| 217064 | 9/1961 | Austria . |
| 328481 | 3/1976 | Austria . |
| 1458762 | 3/1969 | Fed. Rep. of Germany . |
| 2628447 | 1/1978 | Fed. Rep. of Germany . |
| 557395 | 6/1942 | United Kingdom . |

*Primary Examiner*—Melvyn J. Andrews

*Attorney, Agent, or Firm*—Ostrolenk, Faber, Gerb & Soffen

[57] ABSTRACT

There is disclosed a shaft furnace for the direct reduction of iron ores. It includes a gas feed device arranged centrally in the bottom of the shaft furnace in the longitudinal axis of the shaft furnace and having a central cavity. From the cavity, a plurality of gas outlets for the reduction gas, superposed in stages and passing through the gas feed device in its upper part, lead into the interior of the shaft furnace. In order to provide a shaft furnace with which operational failures caused by the gas feed device are prevented and with which the gas feed device is subject to little wear so that it need be exchanged in large time intervals only, the gas feed device is designed as a double-shelled hollow body. The shell interspace of the hollow body is connected to at least one supply duct and at least one discharge duct for a coolant.

7 Claims, 3 Drawing Figures

SHAFT FURNACE ARRANGEMENT FOR THE DIRECT REDUCTION OF IRON ORES

Figure 1:
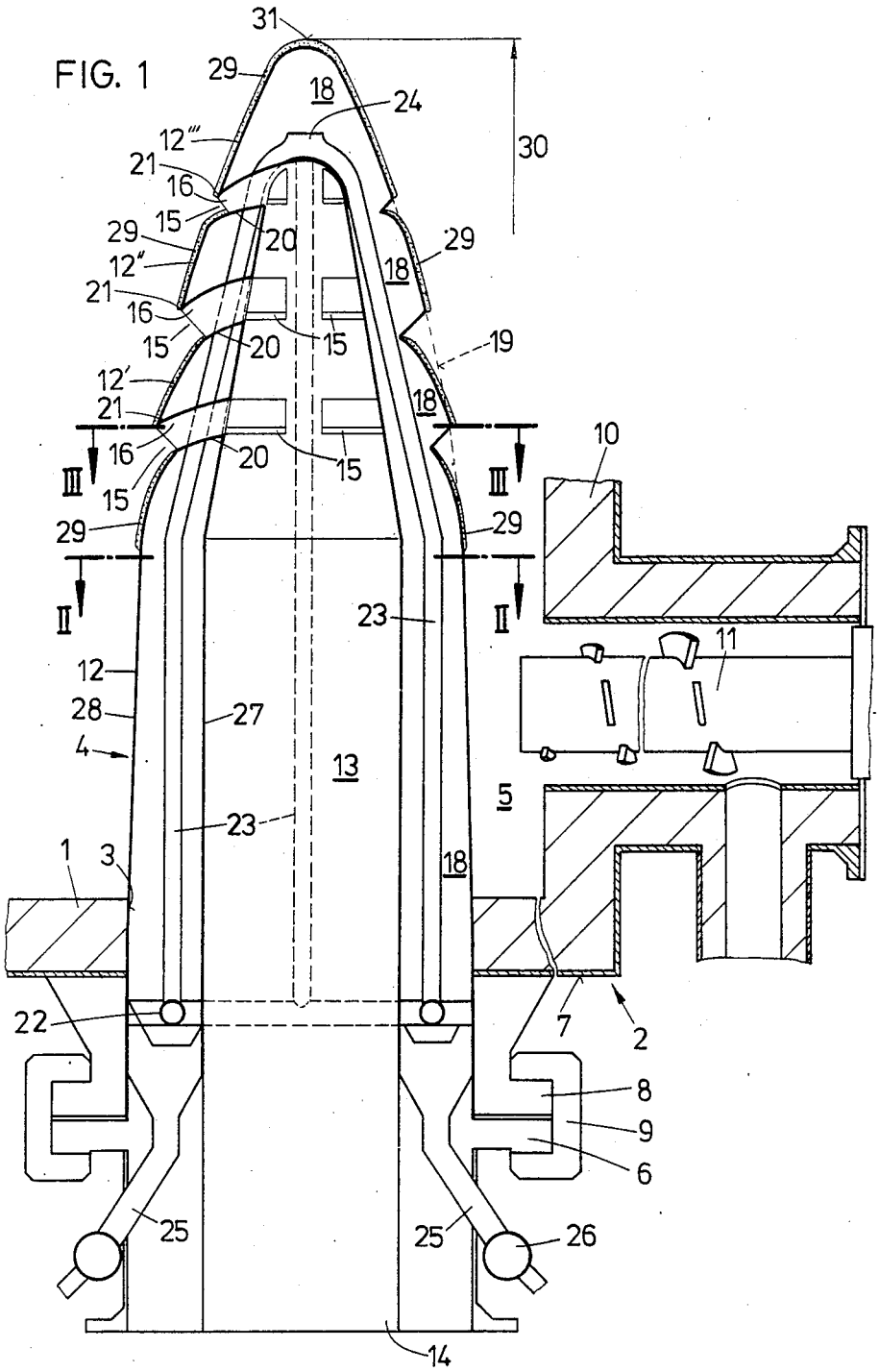

The invention relates to a shaft furnace in particular for the direct reduction of iron ores, with hot discharge, comprising a gas feed means arranged centrally in the bottom of the shaft furnace in the longitudinal axis of the shaft furnace and having a central cavity, from which a plurality of gas outlets for the reduction gas, superposed in storeys and separated by webs, on passing through the gas feed means in its upper part, lead into the interior of the shaft furnace wherein the gas feed means is designed as a double-shelled hollow body closed on its upper end, whose shell interspace is connected to at least one supply duct and at least one discharge duct for a coolant.

A shaft furnace for the direct reduction of is known from Austrian Pat. No. 217,064. An air inlet pipe serves for the gas feeding, which is made either of a high-temperature resistant alloy or with a layer of ceramic material. A high-temperature resistant alloy involves high costs; a layer of ceramic material is not satisfactory, either, because this ceramic material is susceptible to impacts and shocks and may easily become damaged by charging stock falling down. This is, therefore, an unsatisfactory solution in terms of force absorption.

The invention aims at avoiding these disadvantages and difficulties and has as its object to provide a shaft furnace of the initially described kind, with which operational failures caused by the gas feed means are prevented and with which the gas feed means is subject to little wear so that it need be exchanged in large time intervals only.

This object is achieved according to the invention in that the gas feed means is designed as a double-shelled hollow body, the shell interspace of the hollow body being connected to at least one supply duct and at least one discharge duct for a coolant.

Advantageously, the double-shelled hollow body is divided into superposed segments and the gas outlets are designed as slots lying between the segments, wherein the upper end of the hollow body is closed.

A particularly effective cooling of the gas feed means may be realized by connecting the segments of the hollow body by hollow bridging members interrupting the slots.

In order to keep the load forces that occur at the gas feed means on account of the burden column being divided by the gas feed means as low as possible, the part of the hollow body comprising the gas outlets suitably is designed to taper upwardly, wherein it is particularly advantageous for the absorption of lead forces, if the enveloping surface of the part of the hollow body comprising the gas outlets is designed to be paraboloidal.

In addition, it is suitable if the segments of the hollow body as such are also designed to be paraboloidal.

To protect the gas outlet openings, the upper ends of the segments advantageously are covered by the lower ends of the superposed segments, seen from above.

Cooling of the hollow body will be particularly effective if upwardly open supply ducts for the coolant are provided in the shell interspace, leading up as far as to the uppermost part of the hollow body, which supply ducts, on their upper ends, suitably run into a central delivery part on penetrating the bridging members connecting the segments.

A preferred, structurally simple, embodiment is characterized in that the supply ducts are connected by an annular duct arranged on the lower end of the hollow body, wherein the shell interspace on the lower end of the hollow body advantageously runs into several discharge ducts for the coolant, which are also connected to an annular duct.

In order to be able to effectively withstand the high thermal load, the internal and external shells of the hollow body preferably are made of heat-resistant steel, the external shell of the hollow body suitably being provided with a wear-resistant layer on the surfaces directed upwardly and outwardly.

According to a preferred embodiment, the upper end of the hollow body lies below the load pressure point, the load pressure point being that point in the shaft furnace from which the frictional forces prevailing between the burden column and the shaft wall are sufficient to support the burden column.

Preferably, the hollow body is exchangeably fastened in the bottom of the shaft furnace by means of a quick-lock by penetrating the bottom of the shaft furnace.

Figure 2:
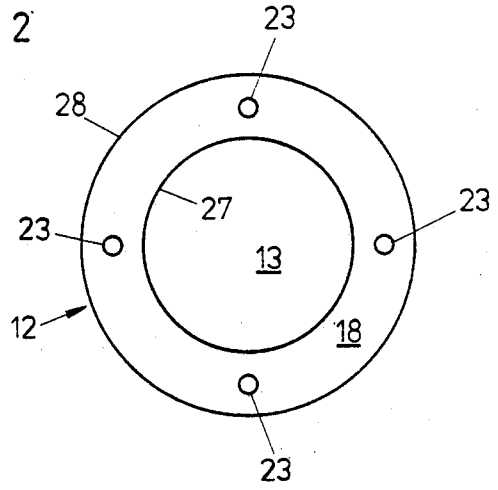
Figure 3:
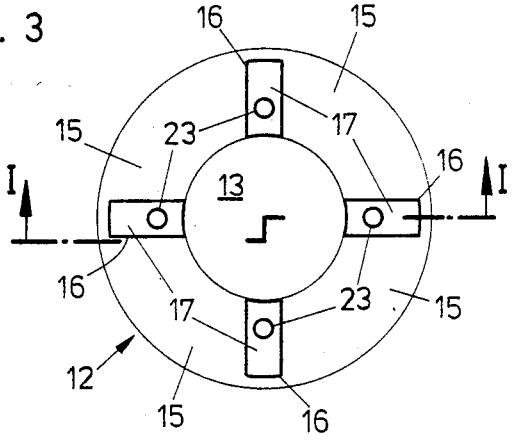

The invention will now be explained in more detail with reference to the accompanying drawings, wherein:

FIG. 1 is a longitudinal section through the lower part of a shaft furnace; and FIGS. 2 and 3 are sections along lines II—II and III—III, respectively, of FIG. 1.

In the bottom 1 of a shaft furnace 2, a central opening 3 is provided, in which a gas feed means 4 is inserted. The gas feed means 4 comprises a flange 6 disposed outside of the interior of the shaft furnace 2 and abutting on a counter flange 8 mounted to the outer side 7 of the bottom. To fix the gas feed means 4, a schematically illustrated bayonet catch means 9 serves, which fastens the two flanges 6 and 8 to each other. This bayonet catch 9 enables the rapid exchange of the gas feed means 4, so that any furnace standstills involved can be kept short. Laterally beside the gas feed means 4, a discharge means, which is designed as a worm conveyor 11, is provided, penetrating the furnace side wall 10.

The gas feed means 4 is formed by a double-shelled hollow body 12 symmetrically disposed about a vertical axis. The central cavity 13 of the hollow body 12 is connected to a duct 14 feeding reduction gas. In the upper third of the hollow body 12, a plurality of slot-shaped gas outlets 15 superposed in stages and passing through the double-shelled hollow body 12, thus connecting its central cavity 13 with the interior 5 of the shaft furnace 2, are provided.

These slot-shaped gas outlets 15 divide the upper part of the hollow body 12 into several segments 12', 12'', 12'''. The segments 12', 12'', 12''' are connected by hollow webs 16 interrupting the gas outlets 15, the cavities 17 of these webs being in communication with the shell interspace 18 of the hollow body 12, i.e., with the shell interspaces of the lower part and the segments 12', 12'', 12''' following thereupon.

The part of the hollow body comprising the gas outlets 15 is designed to taper upwardly, the enveloping surface 19 enveloping this part being shaped paraboloidally. The segments 12', 12'', 12''', too, have paraboloidal outer shells. The upper ends 20 of the segments 12', 12'' are covered in an umbrella-like manner by the lower ends 21 of the superposed segments 12'', 12''', seen from above. The slot-shaped gas outlets 15 as such are downwardly inclined outwards.

In the shell interspace 18, supply ducts 23 for the coolant are provided, leading upwardly from the lower part of the hollow body 12 and connected by an annular duct 22 in the lower part, which supply ducts penetrate the hollow bridging members 16 and run into a central delivery piece 24 provided within the uppermost, closed segment 12''' of the hollow body 12. The coolant, which flows through the supply ducts 23 as far as to the central delivery piece 24, on the upper end of the hollow body 12, is diverted downwardly, flowing through the uppermost segment 12''' and, subsequently, through the cavities 17 of the bridging members 16 connecting this segment 12''' with the lowernext segment 12''. After having flowed through the last segment 12', the coolant enters into the approximately cylindrical lower part of the hollow body 12 and flows off via several discharge ducts 25, which are provided radially symmetrical, and via an annular duct 26 connecting the discharge ducts 25.

The shell of the hollow body 12, i.e., both the internal shell 27 and the external shell 28, are made of heat-resistant steel. The external shell, on its upwardly and outwardly directed surfaces, is provided with a wear-resistant layer 29, so that the abrasion caused by the burden column is kept low.

The height 30 of the hollow body 12 is dimensioned such that the closed upper end 31 of the hollow body 12 lies closely below the load pressure point, the load pressure point being that point from which the frictional forces prevailing between the shaft furnace side wall 10 and the burden column completely support the burden column.

The gas feed means 4 serves to centrally supply the total reduction gas, whereby a homogenous gas distribution over the shaft cross section of the shaft furnace 2 is achieved so as to make possible a reduced structural height of the shaft furnace 2 for a particular furnace output.

What we claim is:

1. In a shaft furnace for the direct reduction of iron ores, which includes means positioned on the bottom thereof for feeding reducing gas thereinto, the improvement wherein said gas feeding means comprises:

(a) a double-shelled body symmetrically disposed about a vertical axis, said body formed by an external shell and an internal shell with an interspace defined therebetween, said double shelled-body being closed at its upper end and said internal shell defining a central cavity, the bottom of said cavity being adapted to communicate with a reducing gas supply, said double shelled body being provided with a plurality of outlets superposed in stages leading from said central cavity into said furnace interior;

(b) a plurality of coolant supply ducts vertically disposed in said shell interspace;

(c) a central coolant outlet arranged at the upper end of said shell interspace and communicating with said coolant supply ducts; and (d) at least one coolant discharge duct communicating with said shell interspace.

2. The improvement as set forth in claim 1, wherein a first annular duct is proved in the lower end of said hollow body, said annular duct communicating with said shell interspace.

3. The improvement as set forth in claim 2, wherein a plurality of coolant discharge ducts are provided on the lower end of said hollow body for communicating with said shell interspace, said apparatus further comprising a second annular duct connected with said coolant discharge ducts.

4. The improvement as set forth in claim 1, wherein said external and said internal shells of said hollow body are made of heat resistant steel.

5. The improvement as set forth in claim 1 having a paraboloidal enveloping surface.

6. The improvement as set forth in claim 1, further comprising means adapted to cooperate with means in a shaft furnace for rapidly and exchangeably fastening said gas feeding means to the bottom of said shaft furnace.

7. The improvement as set forth in claim 1 wherein said double shelled body is divided into superposed segments; said outlets comprise slots lying between said segments, said slots communicating with said central cavity; and said segments being connected by hollow bridging members, the cavities defined thereby communicating with said shell interspace.

* * * * *